US005408857A

United States Patent [19]

Fuhrman et al.

[11] Patent Number: 5,408,857

[45] Date of Patent: Apr. 25, 1995

[54] METHOD AND APPARATUS FOR EXTRUSION OF GEARS

[75] Inventors: William J. Fuhrman, Bloomfield Hills; Alexander Bajraszewski, Richmond, both of Mich.

[73] Assignee: Ford Motor Company, Dearborn, Mich.

[21] Appl. No.: 130,803

[22] Filed: Oct. 4, 1993

[51] Int. Cl.[6] ..... B21K 1/30

[52] U.S. Cl. ..... 72/343; 29/893.34

[58] Field of Search ..... 72/343; 29/893.34

[56] References Cited

U.S. PATENT DOCUMENTS

| | | | |
|---|---|---|---|
| 3,605,475 | 9/1971 | Eakin et al. | 72/256 |
| 3,910,091 | 10/1975 | Samanta | 72/256 |
| 3,911,715 | 10/1975 | Tranter | 72/256 |
| 4,509,353 | 4/1985 | Ike et al. | 72/267 |
| 4,546,635 | 10/1985 | Arita et al. | 72/345 |
| 4,878,370 | 11/1989 | Fuhrman et al. | 72/264 |
| 5,295,382 | 3/1994 | Fuhrman | 72/343 |

*Primary Examiner*—Lowell A. Larson

*Attorney, Agent, or Firm*—Roger L. May; Joseph W. Malleck

[57] ABSTRACT

A method is disclosed for forming helical or spur gears. The method comprises providing a die having a toothed region, positioning a first blank in the toothed region of the die, inserting second and third blanks adjacent the first blank, and applying a force to the third blank. The toothed region of the die includes die teeth projecting into an internal bore of the die, and the force is applied to the third blank to move the second blank through the die until a leading end of the third blank is generally coincidental with a minimum diameter portion of the toothed region. During the application of force to the third blank, the second blank is moved through the toothed region of the die to form external teeth in the blank, and the first blank is ejected from the toothed region. Preferably, the toothed region of the die includes a tapered rake face section and a full depth section, and the minimum diameter portion of the toothed region occurs at an intersection of the tapered rake face section and the full depth section. An apparatus embodying this method is also disclosed.

7 Claims, 1 Drawing Sheet

METHOD AND APPARATUS FOR EXTRUSION OF GEARS

TECHNICAL FIELD

This invention relates to the formation of gears and, more particularly, to an apparatus and method for cold extruding external teeth in gears for motor vehicle transmissions.

BACKGROUND ART

Externally toothed gears, particularly those having fine pitch helical teeth for use in the transmissions of motor vehicles, are typically formed by cold extrusion. For example, U.S. Pat. No. 3,910,091 to Samanta, assigned to the assignee of the present invention, discloses a method and apparatus for cold extrusion of gears in which the first of two hollow billets or blanks is fed into an extrusion die having internal teeth. An advancing punch spears the first blank, and a suitable shoulder on the punch forces the blank partially through the extrusion die. The shoulder stops short of contacting the die teeth, and then returns to its home position. Thereafter, the second blank is inserted into the die and forced against the first blank, advancing the first blank totally through the die to produce full length teeth.

While the punch is stopped, the full-height unrelieved tooth land area of the die teeth minutely imprints the flanks and root fillet areas of the first blank, and because of its high unit loading usually leaves a characteristic stopping zone mark. While this stopping zone imperfection is relatively small, it is measurable and, if left untreated, can affect the performance of the system into which the gear is ultimately placed.

In the case of gears formed with helical teeth, the stopping zone mark can be burnished or ironed out by a normal post-extrusion tooth finishing operation such as rolling or shaving. However, spur gears having straight teeth are generally unrollable during post-extrusion finishing due to the absence of helical overlap. The stopping mark must, therefore, be allowed to remain, or an exorbitant volume of material must be removed from the trailing end of the blank through a facing operation. The stopping zone mark can also be of some concern on gears not intended for secondary finishing.

SUMMARY OF THE INVENTION

The present invention is a method for forming helical or spur gears. The method comprises providing a die having a toothed region, positioning a first blank in the toothed region of the die, inserting second and third blanks adjacent the first blank, and applying a force to the third blank. The toothed region of the die includes die teeth projecting into an internal bore of the die, and the force is applied to the third blank to move the second blank through the die until a leading end of the third blank is generally coincidental with a minimum diameter portion of the toothed region. During the application of force to the third blank, the second blank is moved through the toothed region of the die to form external teeth in the blank, and the first blank is ejected from the toothed region. Preferably, the toothed region of the die includes a tapered rake face section and a full depth section, and the minimum diameter portion of the toothed region occurs at an intersection of the tapered rake face section and the full depth section.

The invention also includes an apparatus for forming gears embodying the method described above. The apparatus comprises a die having a toothed region including die teeth projecting into an internal bore of the die, and a pneumatic or hydraulic punch assembly for applying a force to a top blank until a leading end of the top blank is generally coincidental with a minimum diameter portion of the toothed region. During the application of force to the top blank, an intermediate second blank is moved through the toothed region of the die to form external teeth in the blank, and a lower blank is ejected from the toothed region. The punch assembly preferably includes a mandrel adapted to extend through bores in the generally annular blanks.

Accordingly, it is an object of the present invention to provide a method of forming gears of the type described above in which the gears formed thereby do not have stopping marks in vital regions as left by prior art methods.

Another object of the present invention is to provide an apparatus of the type described above which allows gears to be formed without significant stopping marks.

These and other objects, features, and advantages of the present invention are readily apparent from the following detailed description of the best mode for carrying out the invention when taken in conjunction with the accompanying drawings.

BEST MODE FOR CARRYING OUT THE INVENTION

Figure 1:
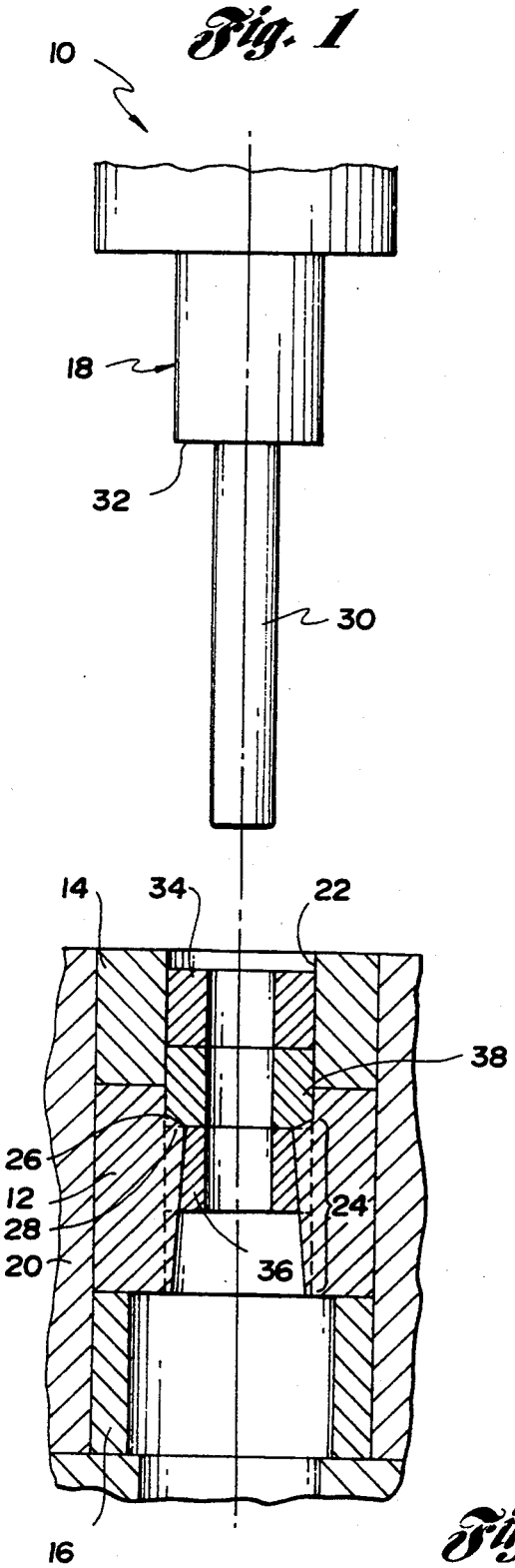
FIG. 1 is a cross-sectional view of an extrusion die apparatus according to the present invention having a punch in a retracted position.

With reference to the drawings, the preferred embodiments of the present invention will be described. FIG. 1 shows an extrusion apparatus 10 according to the present invention for cold extruding external teeth in gears, particularly for motor vehicle transmissions. The extrusion die apparatus 10 comprises a die insert 12, respective upper and lower inserts 14 and 16 flanking the die insert 12, and a punch assembly 18. As is well known, the die insert 12 and the upper and lower inserts 14 and 16 are adapted to be received in a die housing 20 for securely holding them in position. One such arrangement is disclosed in U.S. Pat. No. 3,910,091 to Samanta, assigned to the assignee of the present invention and hereby incorporated by reference. Each of the die inserts 12, 14 and 16 has an internal bore, and at least the die inserts 12 and 14 are aligned in the die housing 20 so that their bores form a continuous inner bore 22.

The die insert 12 has a toothed region 24 including die teeth projecting into the internal bore 22. The toothed region includes a rake face section 26 which tapers up from the bore 22 to a full depth section 28. While the teeth of the full depth section 28 may extend into the inner bore 22 for a constant depth along their entire axial length, it is preferred that the teeth of the full depth section taper slightly back down toward the bore to facilitate ejection of the formed gear blanks, as will be described more fully below.

The punch assembly 18 includes a mandrel 30 with a squared off shoulder 32. As shown in FIG. 1, the punch assembly 18 is initially in a raised loading position to accommodate an incoming billet or blank 34 which is positioned in the upper die insert 14, or alternately in a diametrical pilot of the internally toothed die insert 12. From the preceding forming cycles of the apparatus 10, a lower blank 36 is normally already positioned in the die insert 12, and an intermediate blank 38 is aligned in the inner bore 22 adjacent the lower blank. The blanks 34, 36 and 38 are typically annular, precision-machined steel blanks which may be prepared as described in above-mentioned U.S. Pat. No. 3,910,091.

Figure 2:
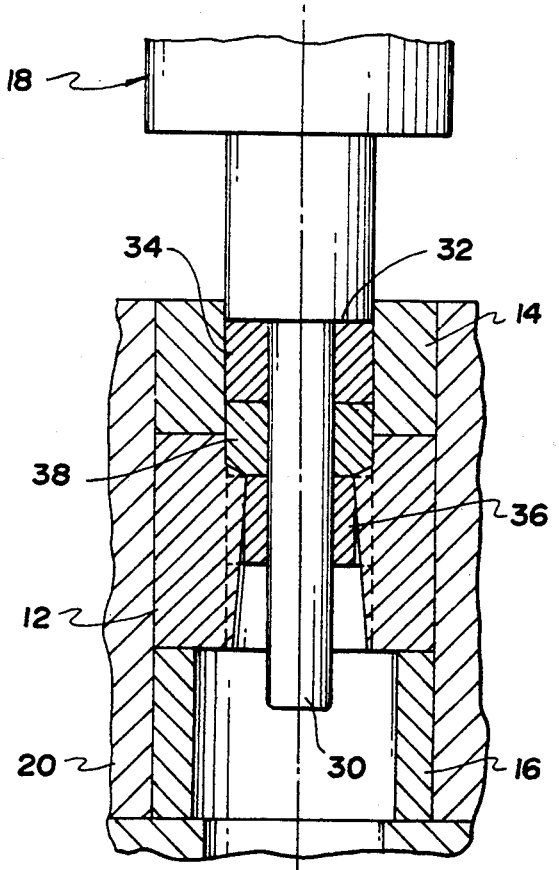
FIG. 2 is a cross-sectional view of the extrusion die apparatus with the punch in an intermediate position.

FIG. 2 shows the punch assembly 18 in an intermediate position between the raised position and a lowered position. The punch assembly 18 may be moved through its range of movement by either a hydraulic or mechanical press, as is well known. As the punch assembly 18 is lowered, the mandrel 30 extends through the inside diameters of the annular blanks 34, 36 and 38, and the shoulder 32 of the mandrel comes into abutment with the top or trailing edge surface of the top blank 34. Although the present invention is illustrated with three blanks, it should be understood that additional blanks can be provided on top of the topmost blank, and more blanks may reside in the die insert 12 during the gear forming process.

Figure 3:
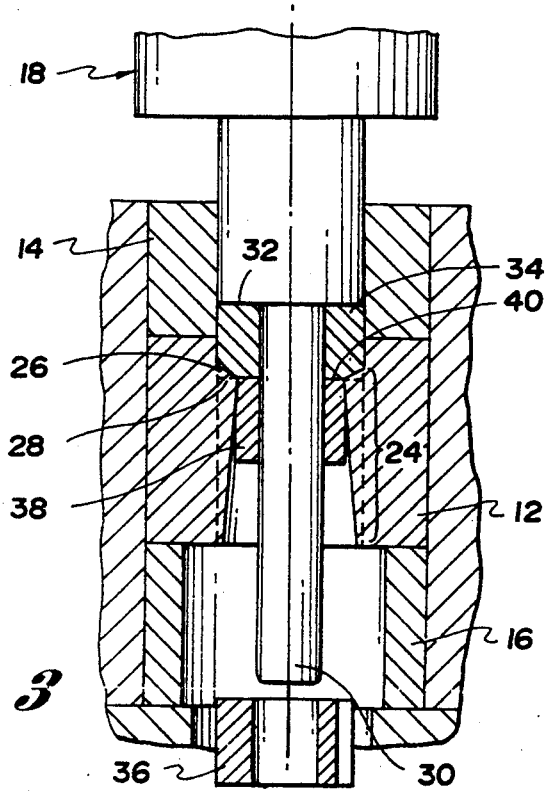
FIG. 3 is a cross-sectional view of the extrusion die apparatus with the punch in an extended position.

FIG. 3 shows the punch assembly 18 in the extended or lowered position. As the punch assembly continues to extend toward its point of farthest extension, the shoulder 32 of the mandrel 30 forces the top blank 34 downwardly against the intermediate blank 38, which in turn exerts pressure on the lower blank 36. The punch assembly 18 exerts force until a leading or forwardmost end 40 of the top blank 34 is generally coincidental with a minimum diameter portion of the toothed region, which preferably occurs at the intersection of the conical rake face section 26 and the full depth section 28. Because the parting line between the first and second billets, respectively 34 and 38, is thereby positioned flush with the minimum diameter of the internal die teeth, the punch shoulder 32 does not interfere with the die teeth rake face.

During the lowering of the punch assembly 18, the intermediate blank 38 is extruded through the internal die teeth spaces in the die insert 12, and the lower blank 36 is moved entirely through the toothed region of the die and ejected therefrom. Whether the die teeth are helical or straight, the thickness of the internal teeth 28 preferably progressively decreases and the root diameter increases from top to bottom as viewed in FIG. 3 to permit the lower blank 36 to drop through the lower die insert 16 after final extrusion to form the pinion or gear. After the punch reaches its maximum designated extension, the force is relaxed, the punch is withdrawn, and a new incoming blank is inserted adjacent to the former top blank 34, which at this point resides at least partially in the die insert 12.

The stop position of the punch 18 is easily adjusted as necessary to optimize the position of the parting line between adjacent blanks. The effects resulting from temporary disruption of metal flow in the blanks during this extrusion process are negligible, and any stopping mark still left in the extruded gear will be close to one end of the gear so that it can be removed along with the extrusion fins during a customary facing operation. The gear teeth, especially if helical, can still be subject as necessary to a normal post-extrusion tooth finishing operation such as rolling or shaving. A circular die rolling process, for example, can be used to impart final size, surface finish, and crown to helical gear teeth.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

We claim:

1. A method of forming gears, the method comprising:

providing a die having a toothed region including die teeth projecting into an internal bore of the die, the toothed region including a tapered rake face section and a full depth section having a generally decreasing depth along its axial length;

positioning a first blank in the toothed region of the die;

positioning a second blank adjacent the first blank and a third blank adjacent the second blank;

applying a force to the third blank to move the second blank through the die until a leading end of the third blank is generally coincidental with a minimum diameter portion of the toothed region and to move the first and second blanks through the toothed region of the die, the minimum diameter portion of the toothed region occurring at an intersection of the tapered rake face section and the full depth section;

relaxing the force; and positioning a fourth blank adjacent the third blank.

2. The method of claim 1 wherein the first blank is moved entirely through the toothed region of the die when the force is applied to the third blank.

3. The method of claim 1 wherein the die teeth are helical.

4. The method of claim 1 wherein the die teeth are straight.

5. The method of claim 1 further comprising machining the first blank after the first blank is moved through the die to remove surplus material.

6. The method of claim 1 further comprising facing a trailing end of the first blank after the first blank is moved through the die to remove surplus material.

7. The method of claim 1 further comprising finishing the teeth formed in the first blank after the first blank is moved through the die.

* * * * *